US006492766B1

(12) United States Patent
Tsuzurahara et al.

(10) Patent No.: US 6,492,766 B1
(45) Date of Patent: Dec. 10, 2002

(54) COLOR CATHODE RAY TUBE WITH WIDE DEFLECTION ANGLE

(75) Inventors: Mamoru Tsuzurahara, Mobara (JP); Kenichi Watanabe, Otaki (JP); Syouji Shirai, Mobara (JP); Shinichi Kato, Mobara (JP); Go Uchida, Mobara (JP); Hirotsugu Sakamoto, Chiba (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 0 days.

(21) Appl. No.: 09/532,747

(22) Filed: Mar. 22, 2000

(30) Foreign Application Priority Data

Mar. 23, 1999 (JP) ..... 11-077595

(51) Int. Cl.[7] ..... H01J 29/58

(52) U.S. Cl. ..... 313/414; 313/477 R; 313/413; 313/415

(58) Field of Search ..... 313/412, 413, 313/414, 415, 477 R; 315/382.1

(56) References Cited

U.S. PATENT DOCUMENTS 6,329,747 B1 * 12/2001 Noguchi et al. ..... 313/414
6,342,758 B1 * 1/2002 Nakamura et al. ..... 313/414
6,396,204 B1 * 5/2002 Park et al. ..... 313/477 R

* cited by examiner

*Primary Examiner*—Michael H. Day
(74) *Attorney, Agent, or Firm*—Antonelli, Terry, Stout & Kraus, LLP

(57) ABSTRACT

A color cathode ray tube has excellent focusing characteristics over the whole screen thereof, as well as a total length which is short, thus providing a compact monitoring device. The Cathode ray tube has an electron gun in which the ratio between the diagonal size De of a phosphor screen and the distance Lg from the center of the phosphor screen to an end portion of a focusing electrode which forms a main lens portion of the electron gun and faces an anode electrode in an opposed manner is set to De/Lg>1.5. The focusing electrode and the anode electrode have single opening portions whose opening size in the horizontal direction is not less than 68% of the outer diameter of a neck portion and end surfaces of the opening portions face each other in an opposed manner in the tube axis direction along which the electron beams pass.

19 Claims, 9 Drawing Sheets

COLOR CATHODE RAY TUBE WITH WIDE DEFLECTION ANGLE

BACKGROUND OF THE INVENTION

The present invention relates to a color cathode ray tube, and more particularly to a color cathode ray tube having a wide deflection angle and which is equipped with an in-line type electron gun having excellent focusing characteristics.

The color cathode ray tube used as a monitor of a television receiver and an information terminal accommodates an electron gun which emits a plurality of electron beams in one end of a vacuum envelope and has a phosphor screen (image screen) on which phosphor films of a plurality of colors are coated on an inner surface of the other end of the vacuum envelope. The color cathode ray tube is also provided with a deflection yoke on an outer portion of the vacuum envelope, which the deflection yoke performs a two-dimensional scanning of electron beams from the electron gun on the phosphor screen so as to display a given image.

Further, in many color cathode ray tubes, a shadow mask which constitutes a color selection electrode is installed close to the phosphor screen and a plurality of electron beams emitted from the electron gun are made to pass through the color selection electrode and impinge on the respective phosphor films so as to form color images.

To improve the color image formed on the phosphor screen over the whole screen area, a color cathode ray tube equipped with an electron gun as part of a system which applies high voltages other than an anode voltage to a plurality of electrodes which focus the electron beams and form a multi-stage focusing lens is known.

As such an electron gun, a so-called in-line type electron gun which emits three electron beams in parallel on a plane is most common.

FIG. 8A and FIG. 8B are schematic cross-sectional views illustrating the schematic structure of the conventional in-line type electron gun, wherein FIG. 8A is a horizontal cross-sectional view as seen from a direction perpendicular to the in-line direction and FIG. 8B is a vertical cross-sectional view as seen from the in-line direction.

This electron gun includes an electron beam generating portion which is comprised of three cathodes 1 arranged in the in-line direction, a first electrode (control electrode) 2 and a second electrode (accelerating electrode) 3 and a pre-focusing lens portion which is comprised of the first electrode 2, the second electrode 3 and a third electrode 4. Further, in the direction toward the phosphor screen from the third electrode 4, a fourth electrode 5 and a fifth electrode 6 which is divided into a first fifth electrode 61 and a second fifth electrode 62 are arranged in sequence, and the fourth electrode 5 is electrically connected with the second electrode 3 so as to have the same potential and is sandwiched between the third electrode 4 and the fifth electrode 6 to which a high voltage is applied, thus forming a first-stage focusing lens (UPF: Uni-Potential Focusing).

Further, the electron gun includes the fifth electrode 6 and a sixth electrode 7 to which the anode voltage Eb which is the optimal voltage is applied, and a second-stage focusing lens (BPF: Bi-Potential Focusing) is constituted by the fifth electrode 6 and the sixth electrode 7. That is, a main lens which is formed by combining a UPF lens and a BPF lens is called a U-B lens and is popularly used in a multistage focusing type electron gun.

Numeral 8 indicates a shield cup contiguously connected to the sixth electrode 7. Further, the fifth electrode 6 is divided into two electrodes and is comprised of the first fifth electrode 61 which is electrically connected to the third electrode 4 and the second fifth electrode 62 which faces the sixth electrode 7 so as to form the second-stage focusing lens.

Further, vertical correction plates 6V and horizontal correction plates 6H are respectively mounted on the first fifth electrode 61 and the second fifth electrode 62. That is, on the second fifth electrode 62 side of the first fifth electrode 61, there are mounted the vertical correction plates 6V which are arranged such that they sandwich three electron beams individually from the horizontal direction, while on the first fifth electrode 61 side of the second fifth electrode 62, there are mounted horizontal correction plates 6H which are arranged such that they sandwich three electron beams from the vertical direction. An electrostatic quadrupole lens is constituted by these vertical correction plates 6V and the horizontal correction plates 6H.

In the in-line type electron gun having the above-mentioned constitution, a constant focusing voltage Vfs is applied to the first fifth electrode 61, and Vfd+dVf, which is obtained by superposing a dynamic voltage dVf which is increased corresponding to a deflection amount of electron beams to an optimal focusing voltage Vfd at the center of the screen, is applied to the second fifth electrode 62.

This kind of electron gun is disclosed in Japanese Laid-open Publication 189842/1990.

In this electron gun, the electrostatic quadrupole lens constituted by the vertical correction plates 6V and the horizontal correction plates 6H are installed, Vfs is applied to the vertical correction plates 6V, Vfd+dVf is applied to the horizontal correction plates 6H, and Vfs<Vfd+dVf is established; and, hence, the quadrupole lens acts as a focusing lens for the horizontal direction of the electron beams an acts as a divergent lens for the vertical direction.

Due to such actions, the deflection aberration which becomes a cause of a lateral defocusing phenomenon or a horizontal crush of the beam spot generated around the periphery of the screen is corrected. Further, when the electron beams are focused at the center of the screen, a curvature-of-field (curvature-of-field aberration, curvature-of-field defocusing) which causes excessive focusing is generated.

With respect to this phenomenon, since the focusing voltage of the second fifth electrode 62 which faces the sixth electrode (anode) 7 becomes high due to the relationship of Vfs<Vfd+dVf, the focusing action of the above-mentioned second-stage focusing lens is weakened so that the curvature-of-field can be simultaneously corrected and excellent focusing characteristics can be obtained over the whole screen.

SUMMARY OF THE INVENTION

Here, corresponding to the widening of the deflection angle of the electron beams, the above-mentioned deflection aberration and the curvature-of-field are also increased so that in the color cathode ray tubes which have been popularly used as display monitors for personal computers or electronic computer terminals, the deflection angle of the electron beams has been set to approximately 90°.

In converting this deflection angle of 90° into the shape of the color cathode ray tube, by designating the diagonal size of an effective screen as De and the distance from the center of the phosphor screen to the end portion of the focusing electrode which forms the main lens of the electronic gun and faces the anode electrode as Lg, the ratio De/Lg becomes De/Lg ≅1.4.

To consider the mounting of such a color cathode ray tube in a display monitor device, it is preferable that the total length of the color cathode ray tube is short. In case the deflection angle is widened to 100°, for example, to make the color cathode ray tube short, with the same diagonal size of effective screen De of the color cathode ray tube having a deflection angle of 90°, the distance Lg from the center of the phosphor screen to the opposing end portion of the focusing electrode, which forms the main lens of the electron gun and faces the anode electrode in an opposed manner, can be shortened approximately inversely proportional to the tangent angle (expressed as tan (Amax/2) in case the maximum deflection angle is Amax).

Further, in case this deflection angle is increased, it becomes necessary to increase the above-mentioned dynamic voltage dVf. However, in view of the limitation imposed on the actual designing of a dynamic focusing circuit at the monitor side, a sufficient dynamic voltage cannot be applied, thus giving rise to the deterioration of the focusing at the periphery of the screen.

Further, the increase of the dynamic voltage dVf makes the drive source per se expensive so that it is an important task to suppress the dynamic voltage dVf to a low level.

According to the present invention, it has been found when the relationship of Vfs>Vfd+dVf is set at the screen center and the astigmatism is set to be relatively large at the screen center, although the dynamic voltage dVf becomes small, the diameter of the beam spot on the screen is enlarged so that the focusing characteristics are deteriorated.

It is an object of the present invention to provide a color cathode ray tube having a total length which is short, thus providing a monitoring device which is compact and simultaneously exhibiting excellent focusing characteristics over the entire screen.

To achieve the above object, contrary to the above-mentioned electron gun used in the conventional color cathode ray tube where the relationship of Vfs<Vfd+dVf is set at the periphery of the screen, the present invention is characterized by applying the dynamic voltage in such a manner that the relationship of Vfs>Vfd+dVf is set at the screen center.

The typical constitutions of the present invention are as follows.

(1) The color cathode ray tube has the relationship that the ratio between the diagonal size De of the phosphor screen (effective screen) on which at least the phosphors of three colors are coated and the distance Lg from the center of the phosphor screen to the end portion of the focusing electrode which faces the anode electrode in an opposed manner and forms the main lens portion of the electron gun is set to De/Lg>1.5, and the focusing electrode and the anode electrode are constituted such that they have single opening portions whose opening size in the horizontal direction is not less than 68% of the outer diameter of a neck portion, and end surfaces of the opening portions face each other in an opposed manner in the tube axis direction along which the electron beams pass.

(2) The focusing electrode adjacent to the anode electrode which forms the main lens of the electron gun in (1) and to which the anode potential is applied is divided in the tube axis direction; in addition to a constant focusing voltage, a dynamic voltage which is changed corresponding to the deflection amount of the electron beam is superposed to one electrode of the divided focusing electrodes adjacent to the anode electrode, an electrostatic quadrupole lens which changes in the intensity thereof in response to application of the dynamic voltage is provided to at least one portion; and, further, a curvature-of-field correction lens which weakens its focusing action in the horizontal direction as well as in the vertical direction against three electron beams corresponding to an increase of the dynamic voltage is provided at the anode electrode side in the tube axis direction of the electrostatic quadrupole lens.

(3) The electrostatic quadrupole lens and the curvature-of-field correction lens are provided in the electron gun of (1), and further, an electron beam generating portion which generates three electron beams arranged in the horizontal direction is comprised of a cathode, a first electrode and a second electrode which are arranged in the anode electrode direction, and a third electrode and a fourth electrode which are arranged adjacent to the second electrode, and the third electrode is divided into two elements, thus forming another electrostatic quadrupole lens.

(4) The voltage which corrects the astigmatism generated from the potential difference between the just focusing voltages in the horizontal, direction and the vertical direction of the main lens on the electron beam spot at the center of the screen formed of the phosphor screen in (1), (2) or (3) is set to 1.4–2.2 kV, the dynamic voltage at the corners of the screen is set to not more than 600 V, and the diameter of the electron beam spot at the center of the screen is set to not more than 0.6 mm.

(5) The outer diameter of the neck portion which accommodates the electron gun of (1), (2), (3) or (4) and constitutes the vacuum envelope is set to substantially 29 mm, while the opening portions of the focusing electrode and the anode electrode which face each other in an opposed manner are formed into a single laterally elongated shape, wherein the opening size in the horizontal direction is set to not less than 20 mm and the opening size in the vertical direction is set to not less than 9.5 mm.

In the electron gun of the conventional color cathode ray tube, the astigmatism of the main lens is set to approximately hull and the electron beams are focused on the phosphor screen without receiving the action of the electrostatic quadrupole lens at the center of the screen while the action of the electrostatic quadrupole lens is maximized at the periphery of the screen and hence, the defocusing of the beam spot generated by the deflection aberration is corrected. To the contrary, in the electron-gun used for the color cathode ray tube of the present invention, a given astigmatism is provided to the main lens and the action of the electrostatic quadrupole lens at the center of the screen is maximized so that the astigmatism of the main lens is corrected and the beam spot is made to approach a perfect circle.

Since the action of the electrostatic quadrupole lens decreases at the periphery of the screen, the defocusing of the beam spot is corrected in such a manner that the deflection aberration offsets the astigmatism of the main lens. Further, in the present invention, besides the electrostatic quadrupole lens, for correcting the curvature-of-field independently, another correction lens is provided for focusing the electron beams vertically and horizontally at the time of applying the dynamic voltage and for weakening the focusing action corresponding to the increase of the deflection amount of the electron beams and, hence, the dynamic voltage can be reduced more than in the conventional electron gun.

Further, by establishing the relationship that the ratio between the effective screen diagonal size De and the distance Lg from the center of the phosphor screen to the end portion of the focusing electrode which faces the anode electrode in an opposed manner and forms the main lens portion of the electron gun is set to De/Lg>1.5 and by making the structures of respective opposing portions of the focusing electrode and the anode electrode have a large opening size with the opening size in the horizontal direction being not less than 20 mm and the opening size in the vertical direction being not less than 9.5 mm, the focusing voltage is reduced by the main beam having the large opening size, while by providing the correction lens for correcting the curvature-of-field, the diameter of the beam spot can be made small and the effect that the dynamic voltage drive is further reduced can be obtained.

FIG. 9A and FIG. 9B show waveforms of the dynamic voltages applied to the electron gun, wherein FIG. 9A is the waveform of the dynamic voltage applied to the electron gun of the conventional color cathode ray tube and FIG. 9B is the waveform of the dynamic voltage applied to the electron gun of the color cathode ray tube of the present invention. In the drawing, 1H indicates one horizontal period and 1V indicates one vertical period.

FIG. 10A and FIG. 10B are explanatory views of an optical model of the electron gun, wherein FIG. 10A indicates the optical model of the electron gun of the conventional color cathode ray tube and FIG. 10B indicates the optical model of the electron gun of the color cathode ray tube of the present invention.

In the conventional electron gun, the dynamic voltage is applied to the focusing electrode which constitutes the main lens ML (convex lens in the horizontal direction as well as in the vertical direction in FIG. 10A) so as to weaken the intensity of the main lens at the time of deflecting the electron beams toward the periphery of the screen (in FIG. 10A, this phenomenon is expressed by a lens having a thickness smaller in the horizontal direction as well as in the vertical direction than the main lens ML in case of the screen center) thus correcting the curvature-of-field aberration, and simultaneously, the electrostatic quadrupole lens QL (concave lens in the vertical direction and convex lens in the horizontal direction in FIG. 10A) corrects the astigmatism.

In general, although the intensity of the electrostatic quadrupole lens can be relatively easily adjusted, since the intensity of the main lens is set to a proper intensity so as to focus the electron beam to the phosphor screen, a sufficient adjustment of the intensity of the main lens is difficult.

Accordingly, although the correction sensitivity of the astigmatism can be enhanced by increasing the intensity of the electrostatic quadrupole lens, with respect to the curvature-of-field (curvature-of-field aberration), it is difficult to enhance the correction sensitivity of the astigmatism-more than the correction sensitivity determined by the intensity of the main lens.

It is necessary to take a balance between the correction sensitivity of the astigmatism and the correction sensitivity of the curvature-of-field aberration, and, hence, it is impossible to enhance only the correction sensitivity of the astigmatism. Accordingly, in the conventional electron gun, there is almost no space for reducing the dynamic voltage by enhancing the sensitivity.

On the other hand, the present invention is characterized by providing a curvature-of-field aberration correction lens FL (FIG. 10B shows only a convex lens in the horizontal direction in case of the screen center) independently from the main lens ML, besides the electrostatic quadrupole lens QL for correcting the astigmatism.

The curvature-of-field aberration correction lens FL is a non-axisymmetric lens formed by facing longitudinally elongated openings (vertically elongated openings) in an opposed manner, that is, a slit lens (not shown in the drawing) and the focusing force is intensified more in the horizontal direction than in the vertical direction.

At the corners of the screen, as can be also understood from the waveform of the dynamic voltage in FIG. 9B, the potential difference at the electrostatic quadrupole lens portion and the slit lens portion is small, and, hence, the intensity of the lens is weak. At the center of the screen, the lens intensity of both of the electrostatic quadrupole lens and the curvature-of-field aberration correction lens (=slit lens) is maximized, and, hence, the astigmatism of the main lens is corrected. At the corners of the screen, the intensity of the electrostatic quadrupole lens, the intensity of the curvature-of-field aberration correction lens and the intensity of the main lens are respectively minimized.

Accordingly, the focusing action against the electron beams at the corner of the screen is minimized, and, hence, the curvature-of-field aberration can be corrected. Although the effect that the curvature-of -field aberration is corrected by the dynamic voltage applied to the main lens electrode is the same as the effect of the above-mentioned conventional electron gun, the correction effect is increased by an amount of the correction effect obtained at the slit lens, and, hence, the curvature-of-field aberration can be corrected with the low dynamic voltage.

In the main lens of the electron gun used f or the color cathode ray tube of the present invention, the opposing portions of the electrodes which face each other in an opposed manner have a large opening size, wherein the opening size in the horizontal direction is set to not less than 20 mm and the opening size in the vertical direction is set to not less than 9.5 mm so that the focusing voltage Vf of the electron beam can be reduced, and, accordingly, the dynamic voltage superposed on the focusing voltage can be reduced. As well known, a main lens having a large opening reduces the spherical aberration, and, hence, the diameter of the electron beam spot can be minimized.

The present invention is not limited to the above-mentioned constitutions and embodiments described hereinafter and various modifications are possible without departing from the technical concept of the present invention.

DESCRIPTION OF THE PREFERRED EMBODIMENTS

The best mode for contemplating the present invention will be explained hereinafter in conjunction with the drawings which show various embodiments.

Figure 7:
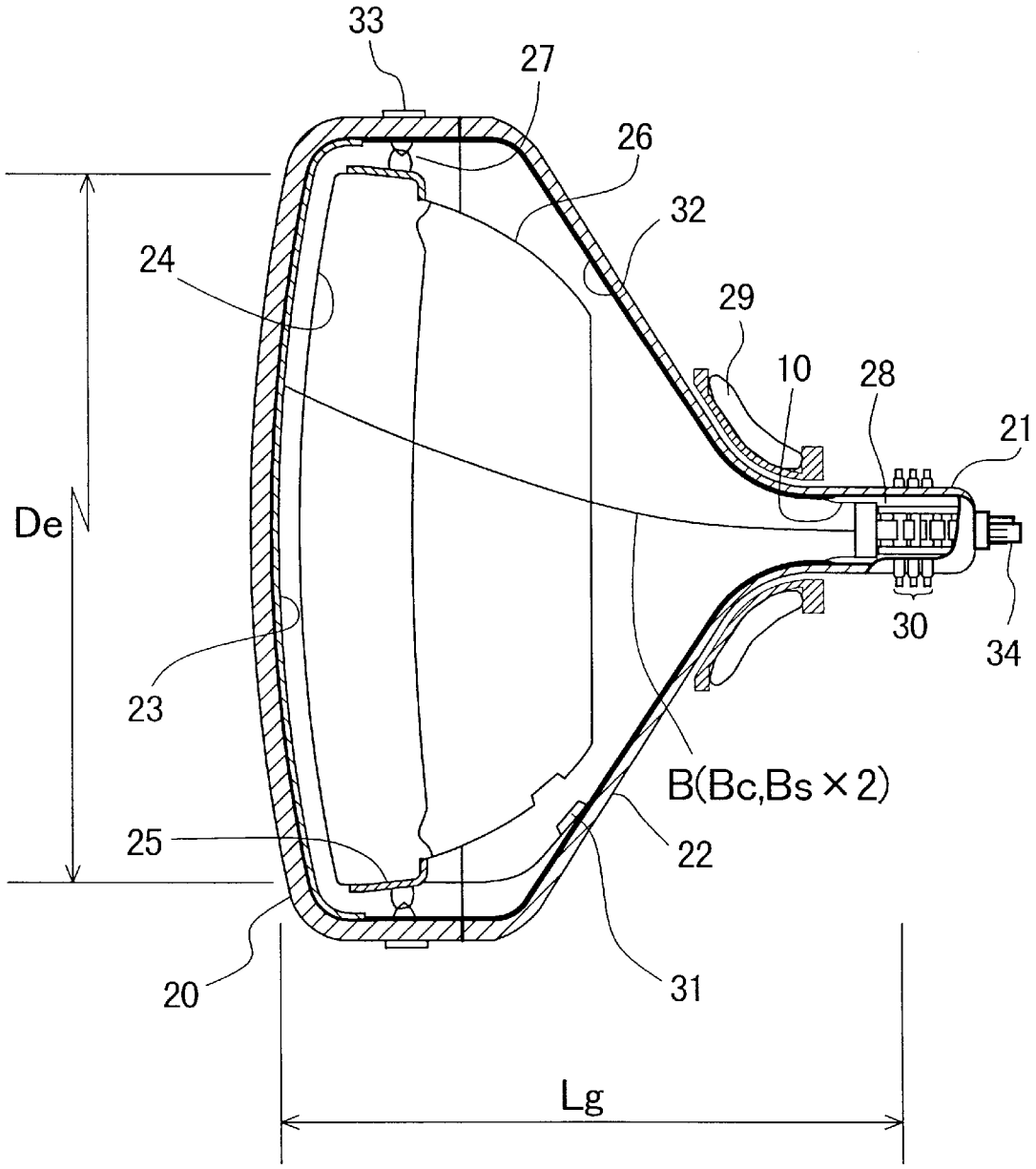
FIG. 7 is a schematic cross-sectional view illustrating the color cathode ray, tube of the present invention.

FIG. 7 is a schematic cross-sectional view of a color cathode ray tube of the present invention. The color cathode ray tube is made of a vacuum envelope which is comprised of a panel portion 20 which has a phosphor screen 23 coated on an inner surface thereof, a shadow mask 24 arranged adjacent to the phosphor screen 23, a neck portion 21 which, accommodates an in-line type electron gun 28 and a funnel portion 22 which contiguously connects the panel portion 20 and the neck portion 21.

In the drawing, De indicates a size in the diagonal direction of the phosphor screen 23 (effective screen).

The shadow mask 24 is held by a mask frame 25 and the mask frame 25 is supported in a suspended manner by studs, which are fixedly secured to the inner surface of a side wall of the panel portion 20, by way of a spring suspension mechanism 27. An inner shield 26 is mounted on the mask frame 25 for shielding an external magnetic field, such as earth magnetism or the like.

To an anode electrode of the in-line type electron gun 28, which is accommodated in the neck portion 21, an anode voltage which is an optimal voltage is supplied from an inner conductive film 32 coated on the inner wall of the vacuum envelope by way of a contact spring 10. This optimal voltage is applied from the outside by way of an anode button switch (not shown in the drawing) provided in the wall surface of the funnel portion.

On a transitional region from the neck portion 21 to the funnel portion 22, a deflection yoke 29 is fitted. This deflection yoke 29 deflects electron beams B (a center beam Bc, a side beam Bs×2) emitted from the electron gun 28 in two directions consisting of a horizontal direction and a vertical direction thus reproducing a two-dimensional image on the phosphor screen 23.

In the drawing, Lg indicates the distance from the center of the phosphor screen (effective screen) 23 to an end portion of a focusing electrode which forms a main lens portion of the electron gun 28 and faces the anode electrode in an opposed manner.

In the conventional color cathode ray tube whose maximum deflection angle in the diagonal direction of the screen is 90°, in case the phosphor screen diagonal size De is approximately 41 cm (nominal 17 inches), approximately 46 cm (nominal 19 inches), or approximately 51 cm (nominal 21 inches), the above-mentioned distance Lg is approximately 293 mm, approximately 326 mm or approximately 355 mm, respectively, and, hence, the ratio De/Lg between the phosphor screen diagonal size De and the above-mentioned distance Lg is less than 1.45.

To the contrary, in the color cathode ray tube of the present invention whose maximum deflection angle in the diagonal direction of the screen is 100°, in case the phosphor screen diagonal size De is approximately 41 cm (nominal 17 inches), approximately 46 cm (nominal 19 inches), or approximately 51 cm (nominal 21 inches), the above-mentioned distance Lg is approximately 258 mm, approximately 282 mm or approximately 314 mm, respectively, and, hence, the ratio De/Lg between the phosphor screen diagonal size De and the above-mentioned distance Lg is around 1.60.

The above-mentioned distance Lg is the size which is obtained when the opposing face of the focusing electrode which faces the anode electrode in an opposed manner is arranged as close as possible to the phosphor screen 23 side within a range that the shape of the electron beam spot on the phosphor screen 23 is not distorted to exceed an allowable value due to the interference of the deflecting field leaked from the deflection yoke 29.

Even in the past, for color television use, a color cathode ray tube whose maximum deflection angle in the diagonal direction of the screen is around 110° has been adopted. However, it is difficult to adopt such a color cathode ray tube whose maximum deflection angle is around 110° as a display monitor of an information terminal which requires a dynamic focusing circuit to enable a display of high definition, large capacity and high resolution in view of the limitation of the dynamic voltage imposed considering the circuit capacity of such a color cathode ray tube.

According to the present invention, although the maximum deflection angle in the diagonal direction of the screen which exceeds 90 degrees is adopted so as to make the length in the tube axis direction (total length) shorter than that of the conventional color cathode ray tube having a maximum deflection angle of 90 degrees, the range of the length is set such that it is maintained below 110 degrees to reduce the dynamic voltage of the dynamic focusing circuit used for the information terminal display monitor.

In the color cathode ray tube whose maximum deflection angle in the diagonal direction of the screen is greater than 90 degrees and smaller than 110 degrees, to make the total length as short as possible within a range that the main lens of the electron gun 28 is not adversely affected by the interference with the leakage magnetic field of the deflection yoke 29, the range of the ratio De/Lg between the diagonal size De of the phosphor screen 23 and the above-mentioned distance Lg is set to approximately 1.5–1.7.

An external correction magnetism device 30 is mounted on the outside of the neck portion 21 for controlling the convergence and color purity of the electron beam. Numeral 31 indicates a getter which is mounted on the mask frame 25. The getter is heated by external heating means for elevating the degree of vacuum in the inside of the vacuum envelope.

As shown in FIG. 7, a stem pin 34 has a proximal portion thereof fixedly secured to an end portion of the neck portion for supplying video signals or operational potentials from an external circuit to the electron gun 28. Numeral 33 indicates an explosion prevention band which is fastened in the vicinity of a joining portion between the panel portion 20 and the funnel portion 22 for preventing the implosion of the vacuum envelope.

Figure 1A:
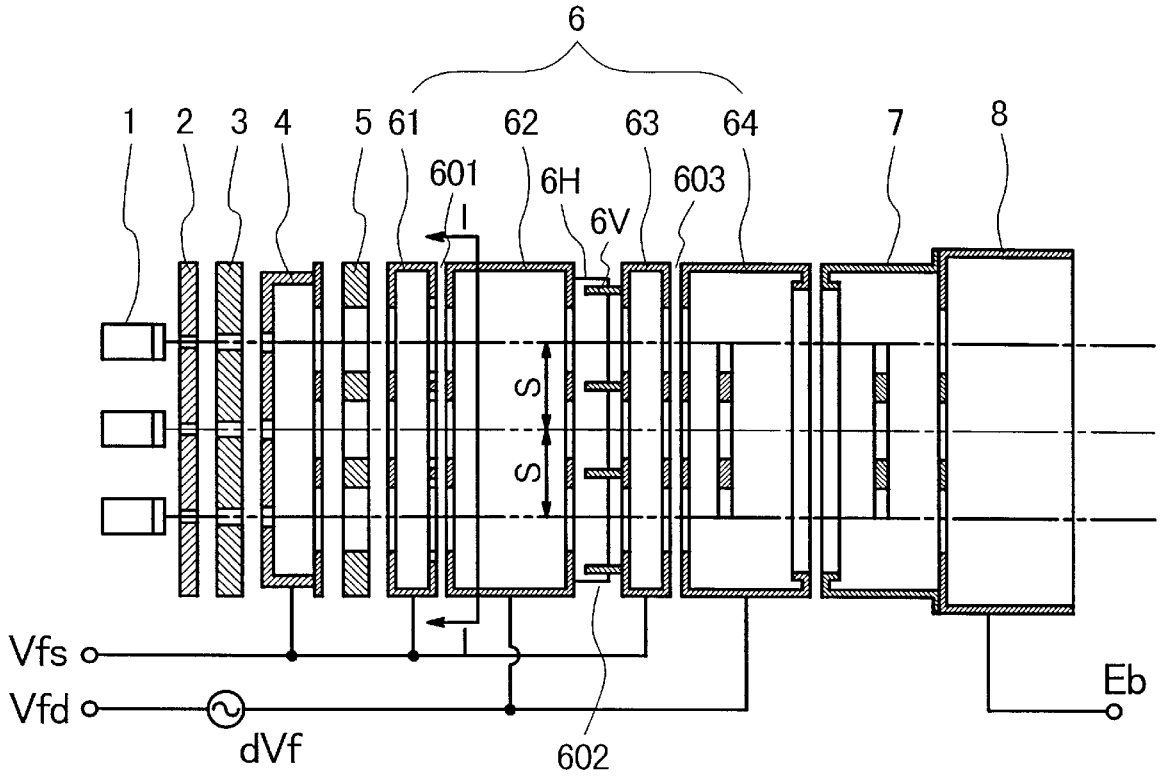
FIG. 1A and FIG. 1B are schematic cross-sectional views of an inline-type electron gun representing a first embodiment of a color cathode ray tube of the present invention.
Figure 1B:
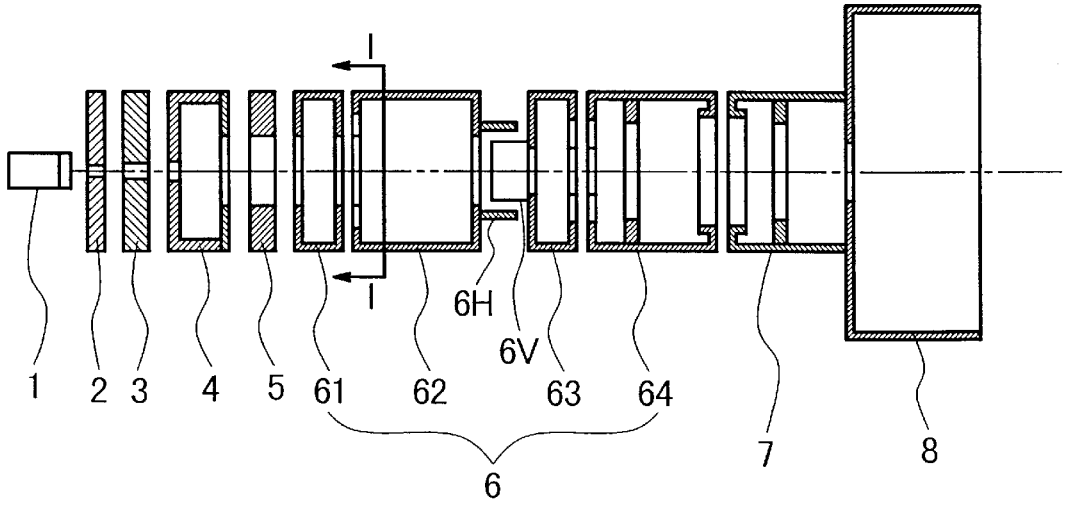

FIG. 1A and FIG. 1B are schematic cross-sectional views of the in-line type electron gun for use the first embodiment of the color cathode ray tube of the present invention, wherein FIG. 1A is a horizontal cross-sectional view as seen from the direction perpendicular to the in-line direction and FIG. 1B is a vertical cross-sectional view as seen from the in-line direction.

Figure 2:
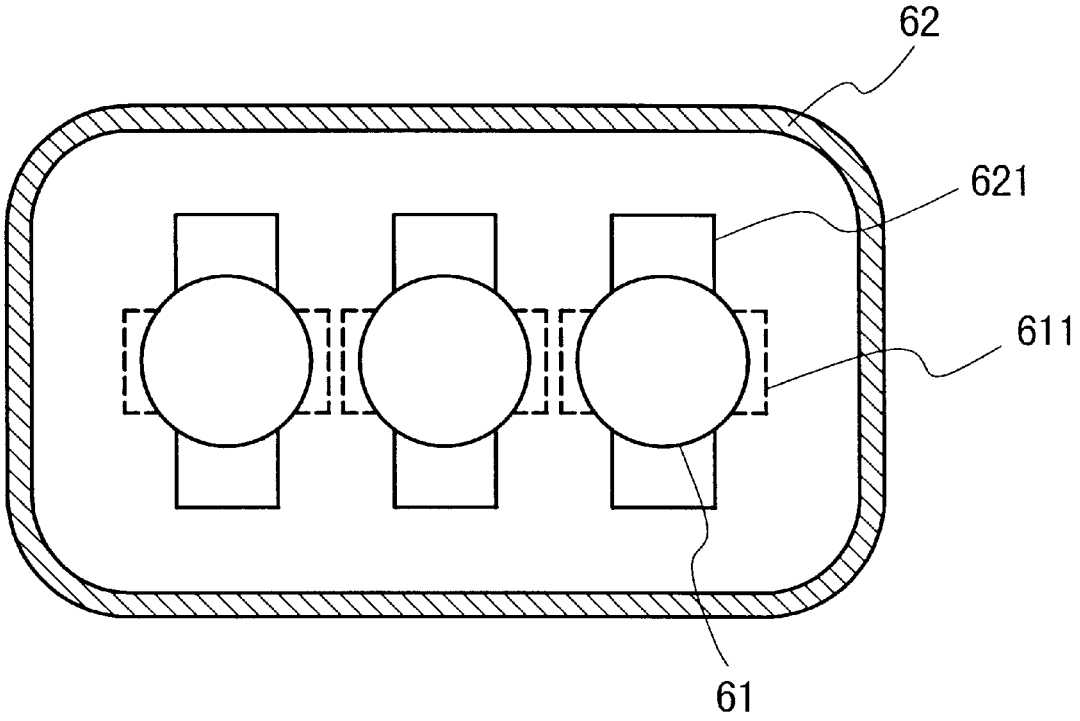
FIG. 2 is a cross-sectional view as seen from an arrow direction I—I of a second fifth electrode in FIG. 1A and FIG. 1B.

FIG. 2 is a cross-sectional view of a second fifth electrode as seen from the direction of an arrow A—A in FIG. 1A and FIG. 1B, wherein numerals 611, 621 indicate openings.

In FIG. 1A and FIG. 1B, numeral 1 indicates cathodes, numeral 2 indicates a first electrode (control electrode), numeral 3 indicates a second electrode (accelerating electrode) and numeral 4 indicates a third electrode; and, a pre-focusing lens is constituted by the first electrode 2, the second electrode 3 and the third electrode 4, which are arranged in sequence in the phosphor screen direction.

Then, a fourth electrode 5 and a fifth electrode 6 are arranged in order. The fourth electrode 5 is electrically connected with the second electrode 3 to have the same potential and is sandwiched by the third electrode 4 and the fifth electrode 6 to which there is applied a focusing voltage which is higher than the voltage applied to the fourth electrode 5. A front-stage main lens is constituted by the third electrode 4, the fourth electrode 5 and the fifth electrode 6. Further, a rear-stage (final-stage) main lens is constituted by the fifth electrode 6 and a sixth electrode 7, which works as an anode electrode and to which the optimal voltage (anode voltage) is applied. As shown in FIG. 1A and FIG. 1B, a shield cup 8 is mounted on the sixth electrode 7 and the anode voltage Eb is applied to the sixth electrode 7 by way of the shield cup 8.

In the embodiment, the fifth electrode 6 is divided into four electrode members, wherein a first fifth electrode 61 and a third fifth electrode 63 are electrically connected with the third electrode 4 and a second fifth electrode 62 is electrically connected with a fourth fifth electrode 64 which faces the sixth electrode 7 and constitutes the final-stage main lens. These electrodes are arranged sequentially in the tube axis direction.

Here, as shown in FIG. 2, at the opposing portions of the first fifth electrode 61 and the second fifth electrode 62, the first fifth electrode 61 and the second fifth electrode 62 face each other in such a manner that a horizontally elongated key hole opening 611 is formed in the first fifth electrode 61 and a vertically elongated key hole opening 621 is formed in the second fifth electrode 62. Accordingly, when the dynamic voltage of FIG. 9B is applied, a front-stage electrostatic quadrupole lens 601, which performs an action to deform the passing electron beams longitudinally, is formed.

Further, on the third fifth electrode 63 side of the second fifth electrode 62, horizontal correction plates 6H are mounted in such a manner that these plates 6H are positioned to sandwich three electron beams from the vertical direction, while on the second fifth electrode 62 side of the third fifth electrode 63, vertical correction plates 6V are mounted in such a manner that these plates 6V are positioned to sandwich three electron beams individually from the horizontal direction.

Figure 9A:
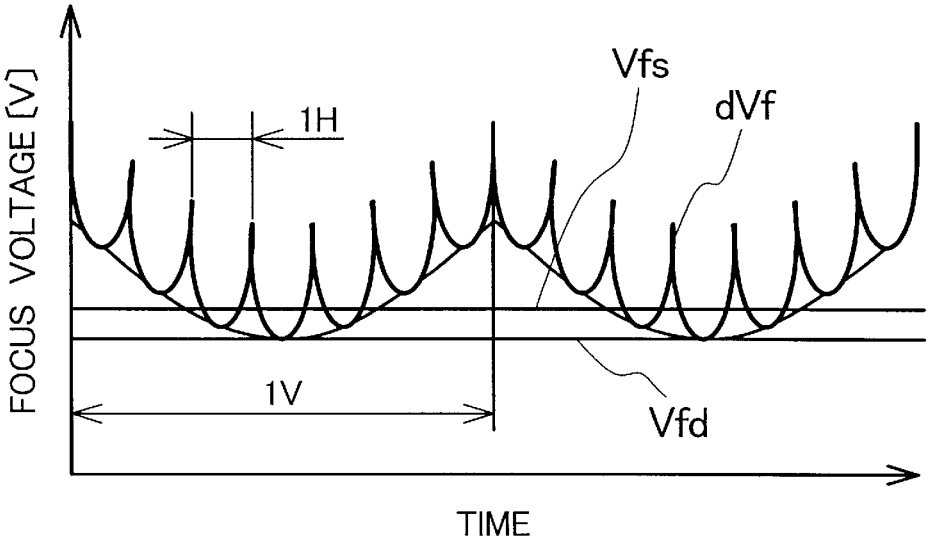
FIG. 9A and FIG. 9B are waveform charts of the dynamic voltage applied to the electron gun.
Figure 9B:
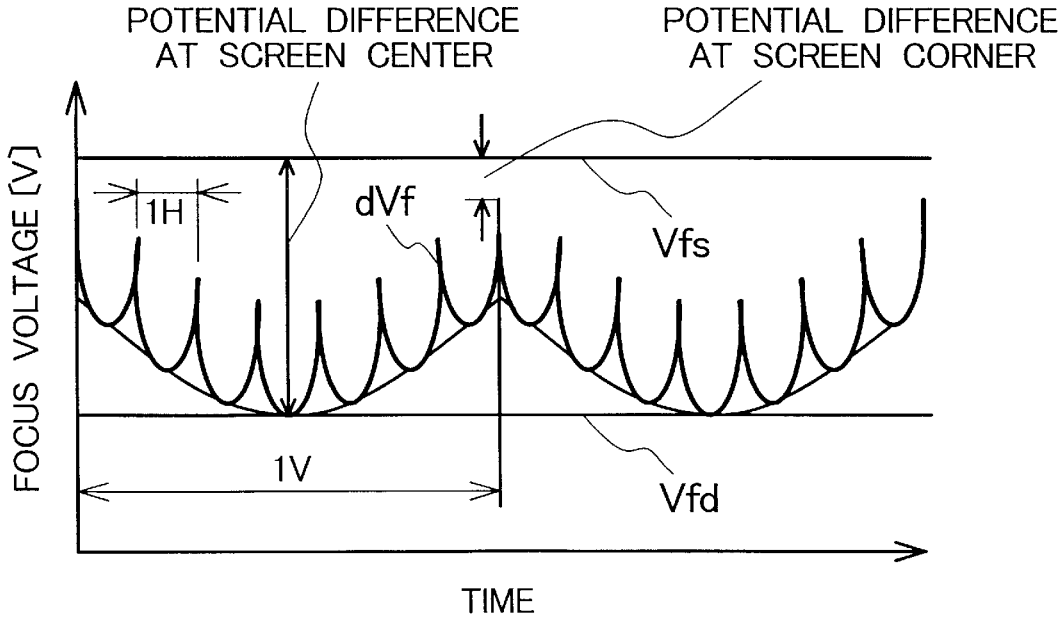
Figure 10A:
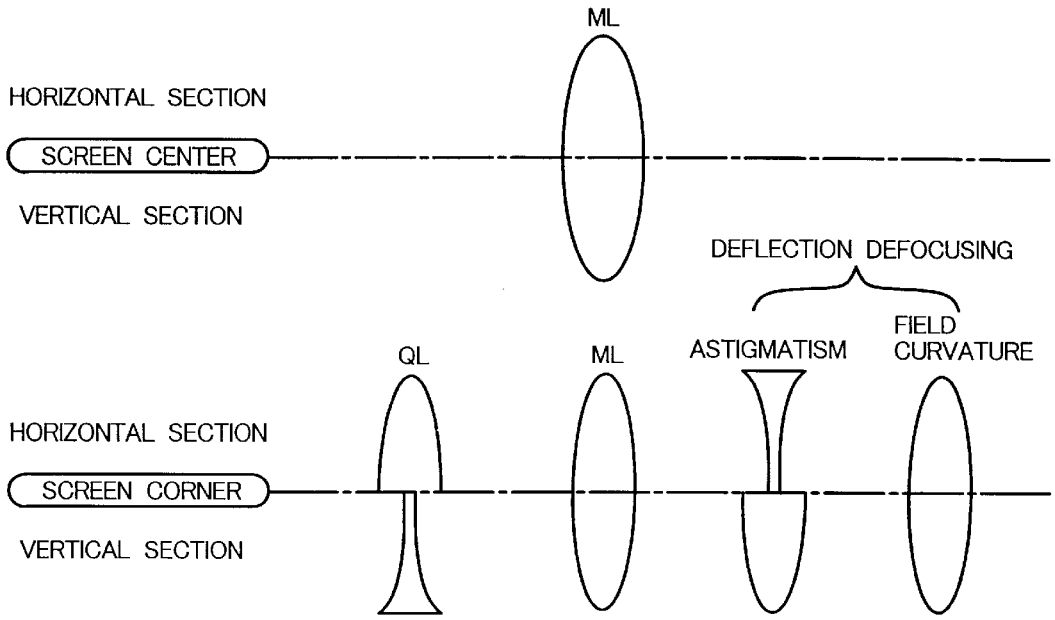
FIG. 10A and FIG. 10B are diagrams illustrating features of an optical model of the electron gun.
Figure 10B:
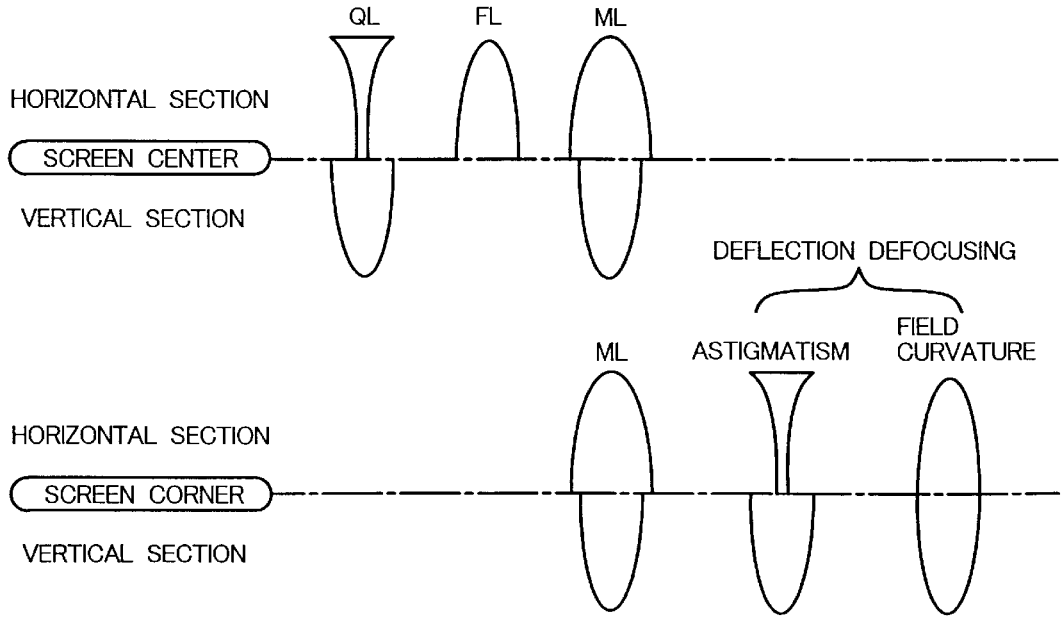

Then, the second fifth electrode 62 and the third fifth electrode 63 are combined such that the horizontal correction plates 6H sandwich the vertical correction plates 6V and the dynamic voltage of FIG. 9B is applied so as to form a rear-stage electrostatic quadrupole lens 602 which performs an action to deform the passing electron beams laterally. With respect to the above-mentioned two electrostatic quadrupole lenses, due to their shapes, the rear-stage electrostatic quadrupole lens 602 has a stronger lens action than the front-stage electrostatic quadrupole lens 601.

The front-stage electrostatic quadrupole lens 601 gives rise to a focusing action in the horizontal direction and a diverting action in the vertical direction, while the rear-stage electrostatic quadrupole lens 602 gives rise to a diverting action in the horizontal direction and a focusing action in the vertical direction. Since these two electrostatic quadrupole lenses give rise to opposite actions from each other in respective horizontal and vertical directions, the astigmatism can be efficiently corrected by controlling the cross-sectional shape of the electron beams incident on the final-stage main lens.

Furthermore, between the third fifth electrode 63 and the fourth fifth electrode 64, a slit lens 603 having a curvature-of-field aberration correction function is formed. The slit lens 603 includes vertically elongated key hole openings which are respectively formed in the third fifth electrode 63 and the fourth fifth electrode 64 and face each other in an opposed manner. Due to such a constitution, the slit lens 603 gives rise to focusing actions in the horizontal direction as well as in the vertical direction, wherein the focusing force in the horizontal direction is larger than the focusing force in the vertical direction, and the above-mentioned focusing actions are weakened corresponding to the increase in the deflection amount of the electron beams.

Since this slit lens 603 facilitates the curvature-of-field aberration correction function of the final-stage main lens, it is effective to dispose the slit lens 603 in the vicinity of the final-stage main lens.

Although an example which mounts a non-axisymmetric lens such as the slit lens which exhibits stronger focusing force in the horizontal direction than in the vertical direction has been explained as the curvature-of-field aberration correction lens in this embodiment, the present invention is not limited to such a non-axisymmetric lens. For example, the same effect can be obtained with an axisymmetric lens where circular holes are formed such that they face each other in an opposed manner thus giving rise to approximately same focusing force in the vertical direction as in the horizontal direction.

Figure 3A:
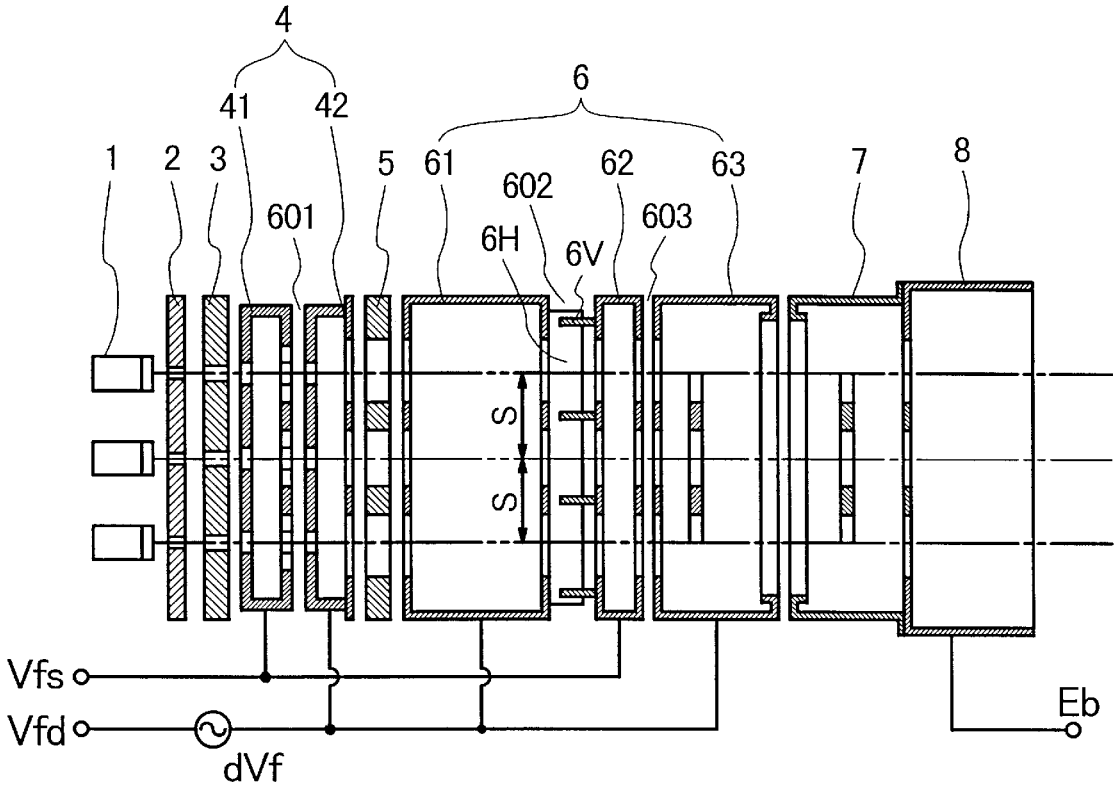
FIG. 3A and FIG. 3B are schematic cross-sectional views of an inline-type electron gun illustrating a second embodiment of a color cathode ray tube of the present invention.
Figure 3B:
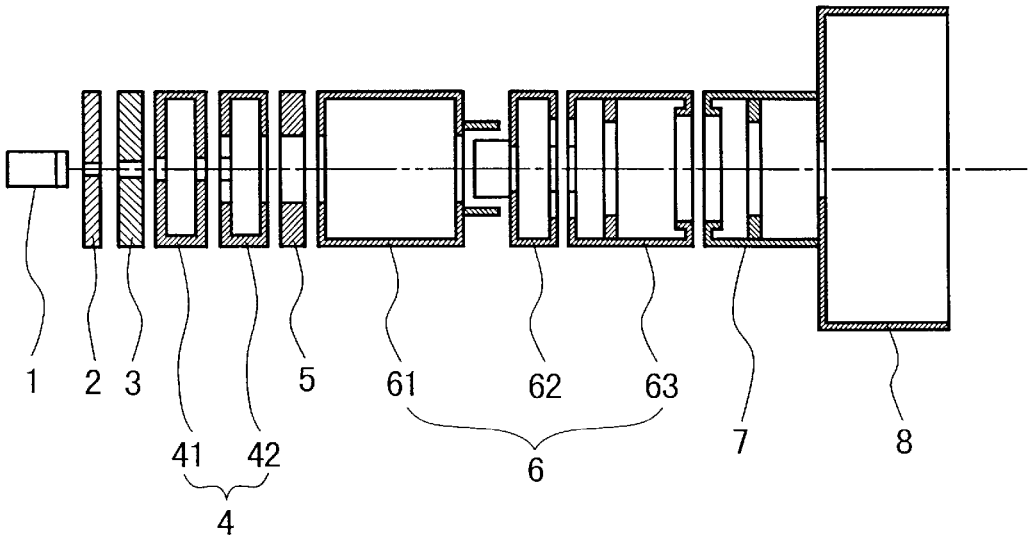

FIG. 3A and FIG. 3B are schematic cross-sectional views of an in-line type electron gun for use in the second embodiment of the color cathode ray tube of the present invention, wherein FIG. 3A is a horizontal cross-sectional view as seen from a direction perpendicular to the in-line direction and FIG. 3B is a vertical cross-sectional view as seen from the in-line direction. The symbols which are the same as the symbols used in FIG. 1A and FIG. 1B correspond to parts having the same functions.

The constitution of this embodiment which differs from that of the previous embodiment is that while the fifth electrode 6 is divided into four electrode members in the previous embodiment, the fifth electrode 6 is divided into three electrode members in this embodiment and the third electrode 4 is divided into two electrode members, that is, a first third electrode 41 and a second third electrode 42.

In this embodiment, the final-stage main lens is constituted by opposing portions of the sixth electrode 7 and the third fifth electrode 63, which face each other, and the slit lens 603 similar to that of the previous embodiment is formed between the third fifth electrode 63 and the second fifth electrode 62. Further, the rear-stage electrostatic quadrupole lens 602 similar to that of the first embodiment is formed between the second fifth electrode 62 and the first fifth electrode 61, and the front-stage electrostatic quadrupole lens 601 similar to that of the first embodiment is formed between the first third electrode 41 and the second third electrode 42.

According to this embodiment, while obtaining an effect similar to the effect of the first embodiment, since the front-stage electrostatic quadrupole lens 601 is formed at a position closer to the electron beam generating side than the first embodiment, the effect of the lens action can be easily enhanced.

As has been described, the color cathode ray tube of the first embodiment of the present invention is provided with an electron gun which adopts a drive system where a relatively large astigmatism correction voltage is set at the center of the screen and a dynamic voltage is a plied, and a relationship is established such that the ratio between the diagonal size De of the phosphor screen (effective screen) of the color cathode ray tube and the distance Lg from the center of the phosphor screen to the end portion of the fourth fifth electrode 64 which forms the final-stage main lens portion of the electron gun and faces the sixth electrode 7 is set to De/Lg>1.5. Then, the structure of the respective opposing portions of the fourth fifth electrode 64, and the sixth electrode 7, which constitutes the final-stage main lens portion of the electron gun that is accommodated in a neck portion having an outer diameter of substantially 29 mm (accurately 29.1±0.7 mm) and an inner diameter of 24 mm (accurately, a thickness of glass being 2.54±0.13 mm) is formed such that these opposing portions respectively have single oblong opening portions with the horizontal opening size of 20.2 mm and the vertical opening size of 10 mm.

In the color cathode ray tube of the second embodiment of the present invention, the electrode which forms the final-stage main lens portion is not the fourth fifth electrode 64 of the first embodiment but is comprised of the third fifth electrode 63 and the sixth electrode 7.

Figure 4:
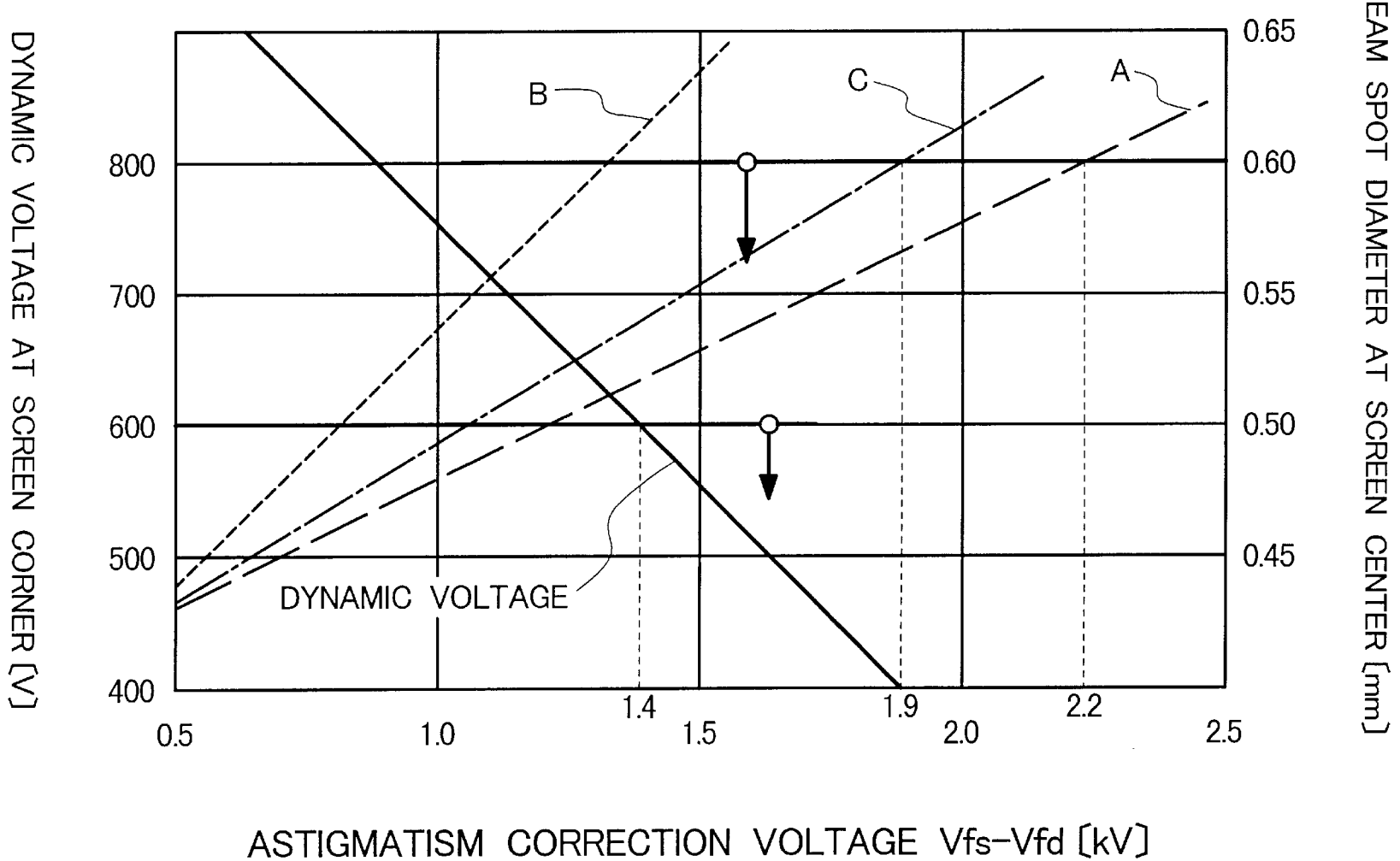
FIG. 4 is a graph illustrating the relationship among the astigmatism correction voltage, the dynamic voltage and the beam spot diameter at the screen center in the color cathode ray tube of the present invention and a conventional color cathode ray tube.

FIG. 4 shows the result of an experiment which confirmed the characteristics of the color cathode ray tube of the present invention and the characteristics of a color cathode ray tube equipped with an electron gun which uses two electrodes of single oblong opening portions having a horizontal opening size of 19 mm and a vertical opening size of 8 mm and adopts the same drive system as that of the present invention.

That is, FIG. 4 is a graph for illustrating the relationship among the astigmatism correction voltage, the dynamic voltage and the beam spot diameter of the screen center with respect to the color cathode ray tubes of the present invention produced as samples and the conventional color cathode ray tube. In the drawing, A and C indicate the characteristics of the color cathode ray tubes of the present invention and B indicates the characteristics of the conventional color cathode ray tube.

The color cathode ray tube for the high definition display monitor whose display dot trio number in the horizontal direction is equivalent to 1.5 M pixels requires a horizontal deflection frequency of not less than 60 kHz, which is four times higher than that of the color cathode ray tube for a commercially available television, and, hence, the frequency of the dynamic voltage applied in synchronism with the deflection also becomes high. Accordingly, even when a high dynamic voltage is applied, since the withstand voltage of the transistor which constitutes the monitor-set-side dynamic voltage drive circuit is limited, the dynamic voltage actually applied to the color cathode ray tube is reduced. To consider the ability of the current dynamic focusing circuit driven in the high definition color cathode ray tube, it is necessary to reduce the dynamic voltage to not more than 600 V in practical use.

Further, in the color cathode ray tube for an ultra high definition display monitor whose display dot trio number in the horizontal direction is not less than 2 M pixels, the horizontal deflection frequency is further increased to not less than 90 kHz, and, hence, it is preferable to further reduce and restrict the dynamic voltage to not more than 400 V.

The beam spot diameter at the screen center in FIG. 4 is a value obtained on the condition that the cathode current Ik of the color cathode ray tube is 300 $\mu$A. This cathode current Ik=300 $\mu$A becomes a standard of the recommended luminance for a color cathode ray tube whose effective screen diagonal size is approximately around 51 cm.

The voltage to correct the astigmatism of the main lens corresponds to a potential difference Vfs−Vfd for forming the electrostatic quadrupole lens against the beam spot on the screen center.

It can be seen from FIG. 4 that, in the color cathode ray tube of the present invention indicated by line A, to meet the condition that the dynamic voltage applied to the electron gun is not more than 600 V and the beam spot diameter at the screen center is not more than 0.6 mmϕ, the astigmatism correction voltage is to be set to 1.4–2.2 kV.

Further, the color cathode ray tube of the present invention indicated by line C uses the final-step main lens portion forming electrode which is formed by disposing the single oblong opening portions having an opening size in the vertical direction of 9.5 mm to face in an opposed manner. That is, by setting the opening size in the vertical direction to not less than 9.5 mm, the astigmatism correction voltage becomes not less than 1.9 kV and the dynamic voltage can be restricted to not more than 400 V. Accordingly, the color cathode ray tube can be adopted as an ultra high definition display monitor, which requires a high-speed horizontal deflection frequency.

In the cathode ray tube for the color display monitor having a screen size in the diagonal direction of approximately around 51 cm, provided that the screen luminance is 100 cd/m$^2$, this beam spot diameter 0.6 mmϕ at the screen center becomes the prerequisite to produce an ultra high definition image display having a display dot trio number in the horizontal direction of 2M pixels.

On the other hand, in the conventional color cathode ray tube indicated by line B in FIG. 4, when the astigmatism correction voltage is increased to not less than 1.4 kV to set the dynamic voltage to not more than 600 V, the beam spot diameter is increased and the above-mentioned condition that the beam spot diameter at the screen center is not more than 0.6 mmϕ cannot be satisfied.

Figure 8A:
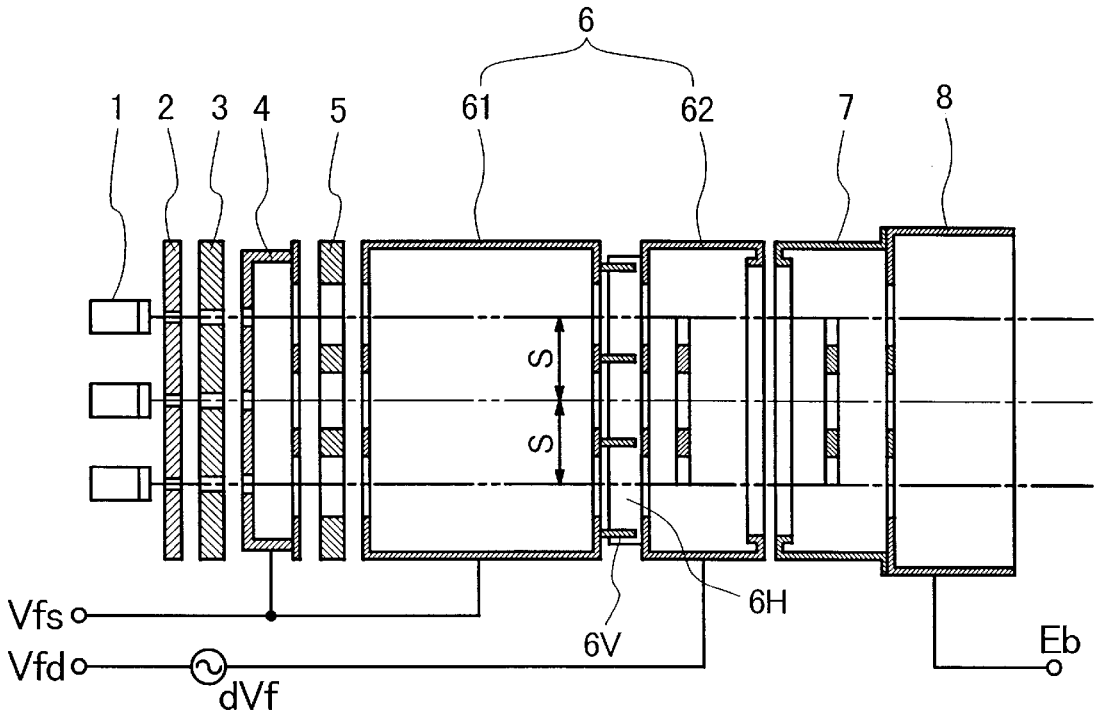
FIG. 8A (PRIOR ART)
FIG. 8A and FIG. 8B are schematic cross-sectional views illustrating the structure of a conventional in-line type electron gun.
Figure 8B:
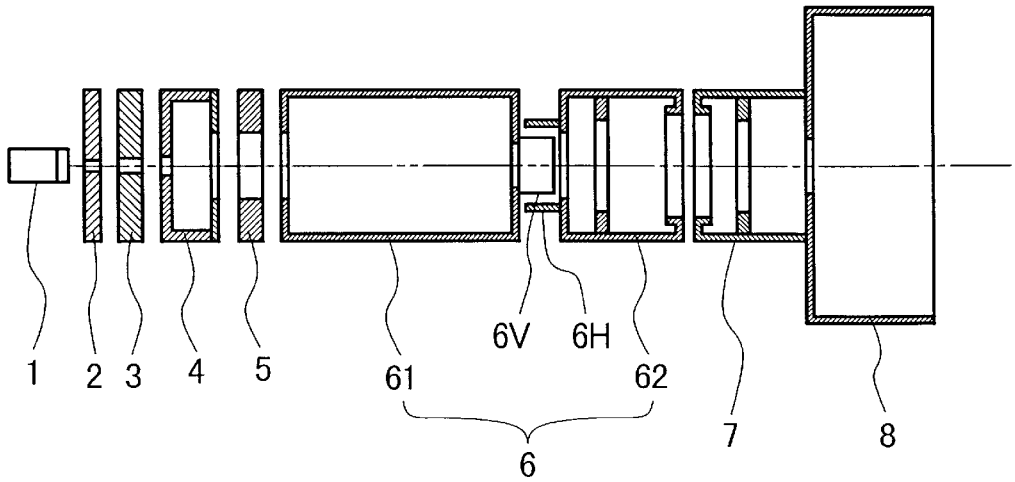
FIG. 8B (PRIOR ART)

Here, in the electron guns which are provided for respective color cathode ray tubes used in the experiment and indicated by lines A, B and C, the arrangement distance S size (symbol S shown in FIG. 1A, FIG. 3A, FIG. 8A) between the center gun (electron gun at center) and the side guns (electron guns at both sides) is set to 5.5 mm such that the-electron guns can be preferably used as CRTs having a large screen and a high definition. That is, when the S size is small, the focusing characteristics and the convergence characteristics are enhanced. However, since a large distance must be assured between the shadow mask and the phosphor screen, the cathode ray tube is liable to receive the influence of magnetic noise from the outside.

In general, the shortest value of the distance from the electron beam center of the side gun at the opposing portions of the electrodes which face each other in an opposed manner and constitutes the main lens portion to the inner wall of the electrodes which constitute the main lens of the electron gun determines the effective main lens diameter of the side gun for the electron beam. Accordingly, in the electron gun of the present invention, when the opening size in the horizontal direction of the opposing portions of the electrodes which constitute the main lens is below 20 mm, the main lens diameter for the electron beam of the side gun in the horizontal direction becomes below 9 mm. Thus, compared to the main lens diameter of not less than 9.5 mm in the vertical direction, which can restrict the dynamic voltage to not more than 400 V, a large difference arises. Therefore, to take a balance between the lens diameter in the horizontal direction and the lens diameter in the vertical direction with respect to the electron beam of the side gun, the opening size in the horizontal direction must be set to not less than 20 mm.

However, when this opening size in the horizontal direction is excessively large, the outer wall of the electrode approaches the inner wall of the neck portion, and, hence, there arises a problem with the withstand voltage characteristics. To assure the needed reliability, it is preferable to set the opening size in the horizontal direction to not more than 80% of the outer diameter of the neck portion. The same goes for the opening size in the vertical direction. However, since the glass beads for supporting a plurality of electrodes are mounted on both sides of the electrode in the vertical direction there is no case in which the opening size in the vertical direction becomes larger than the opening size in the horizontal direction.

With respect to the lens diameter in the vertical direction, however, due to the characteristics of the electron gun of the conventional color cathode ray tube (the opening size in the vertical direction being 8 mm) indicated by line B in FIG. 4 and the characteristics of the electron gun of the color cathode ray tube of the present invention (the opening size in the vertical direction being 10 mm) indicated by line A in FIG. 4, even in the color cathode ray tube indicated by line C in FIG. 4 which sets the opening size in the vertical direction to approximately 9.5 mm, the beam spot diameter becomes substantially equal to that of line A. In this case, by setting the astigmatism correction voltage to approximately 1.4–1.9 kV, a beam spot diameter not larger than the target beam spot diameter (0.6 mmϕ) can be achieved while satisfying the condition that the dynamic voltage is not more than 600 V.

Figure 5:
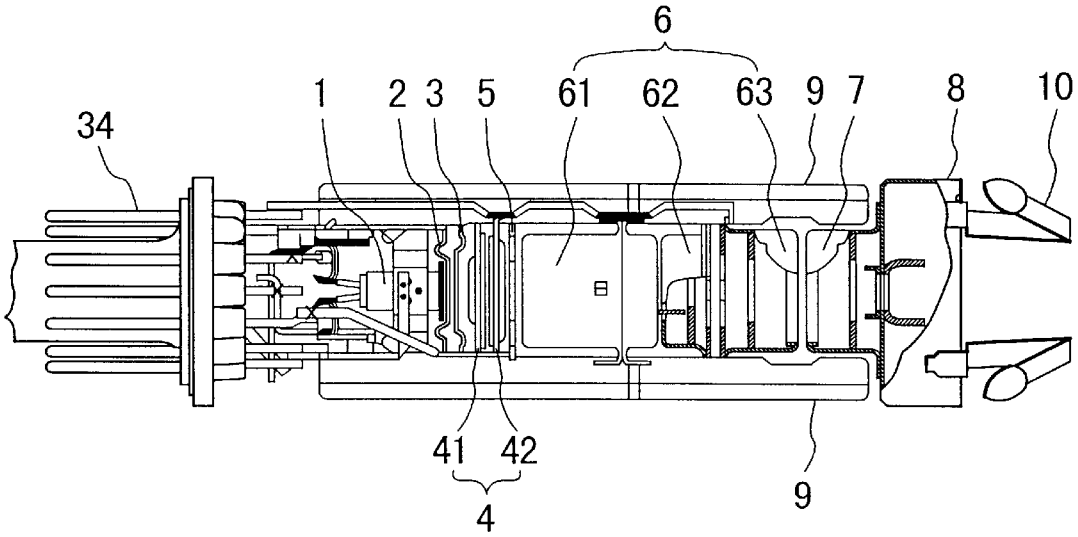
FIG. 5 is a side view showing an essential part in cross section of an in-line type electron gun representing an embodiment of the color cathode ray tube of the present invention as seen from the in-line direction so as to illustrate the specific structure of the electron gun.
Figure 6:
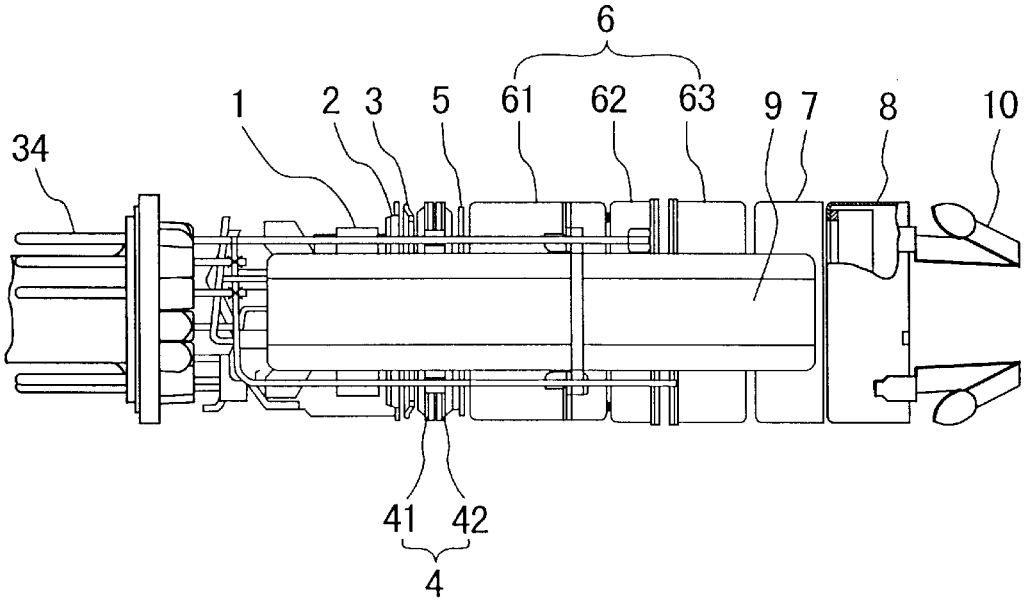
FIG. 6 is a side view of the electron gun of FIG. 5 as seen from a direction perpendicular to the in-line direction.

FIG. 5 is a side view showing an essential part in cross section of the in-line type electron gun provided in the embodiment of the color cathode ray tube of the present invention as seen from the in-line direction. FIG. 6 is a side view of the electron gun shown in FIG. 5 as seen from a direction perpendicular to the in-line direction. FIG. 5 and FIG. 6 correspond to the electron gun explained in the above-mentioned second embodiment.

In FIG. 5 and FIG. 6, numerals which are the same as the numerals used in FIG. 3 correspond to the same parts. In these drawings, numeral 9 indicates insulation rods (beading glass) for fixing the cathode and a plurality of electrodes in a given positional relationship, and numeral 10 indicates a contact spring for introducing the anode voltage Eb in such a manner that the electrode 8*b* is brought into contact with the inner conductive film shown in FIG. 7.

As has been explained in view of FIG. 3, in this electron gun, the third electrode 4 is divided into two electrode members, that is, into the first third electrode 41 and the second third electrode 42, and the electrostatic quadrupole lens is formed at the opposing portions of these electrodes. Further, the fifth electrode 6 is divided into three electrode members, that is, into the first fifth electrode 61, the second fifth electrode 62 and the third fifth electrode 63, and the electrostatic quadrupole lens is formed at the opposing portions of the first fifth electrode 61 and the second fifth electrode 62, while the curvature-of-field correction lens is formed at the opposing portions of the second fifth electrode 62 and the third fifth electrode 63.

With the provision of the electron gun having such a constitution, the color cathode ray tube having a total length which is short and which has excellent focusing characteristics over the whole screen can be provided.

As explained above, by enlarging the diameter of the main lens of the electron gun, the focusing voltage per se can be reduced in general, and, hence, the dynamic voltage can be reduced in a relative manner. Further, there is also an advantage in that a defective potential which induces unnecessary stray emission from the second electrode 3 can be reduced by a reducing amount of the potential of the third electrode 4.

Further, provided that the electrostatic quadrupole lens is called Q and the slit lens is called F, the electron guns of the first embodiment and the second embodiment are characterized by an arrangement of QQF from the cathode side to the anode electrode. The present invention, however, is applicable to electron guns having other arrangements, such as QFF or FQF, which can obtain similar effects. That is, it is needless to say that Q and F are applied in a desired combination to provide a constitution where the relationship that the ratio between the diagonal size De of the phosphor screen (effective screen) of the color cathode ray tube and the distance Lg from the center of the phosphor screen to the center of the main lens of the electron gun is set to De/Lg>1.5; and, as the structure of the main lens portion, there are two electrodes which have single laterally elongated opening portions whose opening sizes in the horizontal direction and in the vertical direction Are not less than 68% and not less than 32% of the outer diameter of the neck portion, respectively, and the end surfaces of the opening portions face each other in an opposed manner in the tube axis direction along which the electron beams pass.

As has been explained heretofore, the present invention can provide a color cathode ray tube equipped with an in-line type electron gun having a total length which is short, has the excellent focusing characteristics over the whole screen, and has excellent focusing characteristics suitable for a wide deflection angle.

What is claimed is:

1. A color cathode ray tube, including a vacuum envelope, which is comprised of a panel portion on which a phosphor screen formed of at least phosphors in three colors is coated and adjacent to which a shadow mask is disposed, a neck portion which accommodates an electron gun which is comprised of an electron beam generating portion which generates three electron beams arranged in the horizontal direction and a main lens portion which focuses and converges said three electron beams onto said phosphor screen, and a funnel portion which connects said panel portion and said neck portion and on which a deflection yoke is mounted for scanning three electron beams emitted from said electron gun on said phosphor screen, wherein:

said main lens portion is comprised of an anode electrode to which an anode voltage is applied and a focusing electrode to which a focusing voltage which is lower than said anode voltage is applied, the color cathode ray tube has the relationship that the ratio between the diagonal size De of said phosphor screen and the distance Lg from the center of said phosphor screen to an end portion of said focusing electrode which faces said anode electrode in an opposed manner is set to De/Lg>1.5, and said focusing electrode and said anode electrode are constituted such that said focusing electrode and said anode electrode have single opening portions whose opening size in the horizontal direction is not less than 68% of the outer diameter of said neck portion and end surfaces of said opening portions face each other in an opposed manner in the tube axis direction along which said electron beams pass.

2. A color cathode ray tube according to claim 1, wherein the opening size in the vertical direction of said single opening portions is not less than 32% of the outer diameter of said neck portion.

3. A color cathode ray tube according to-claim 2, wherein the outer diameter of said neck portion is substantially 29 mm and the opening size in the horizontal direction of said single opening portions is not less than 20 mm.

4. A color cathode ray tube according to claim 3, wherein the opening size in the vertical direction of said single opening portions is not less than 9.5 mm.

5. A color cathode ray tube, including a vacuum envelope, which is comprised of a panel portion on which a phosphor screen formed of at least phosphors in three colors is coated and adjacent to which a shadow mask is disposed, a neck portion which accommodates an electron gun which is comprised of an electron beam generating portion which generates three electron beams arranged in the horizontal direction and a main lens portion which focuses and converges said three electron beams onto said phosphor screen, and a funnel portion which connects said panel portion and said neck portion and on which a deflection yoke is mounted for scanning three electron beams emitted from said electron gun on said phosphor screen, wherein:

said main lens portion is comprised of an anode electrode to which an anode voltage applied and a focusing electrode to which a focusing voltage which is lower than said anode voltage is applied, the color cathode ray tube has the relationship that the ratio between the diagonal size De of said phosphor screen and the distance Lg from the center of said phosphor screen to an end portion of said focusing electrode which faces said anode electrode in an opposed manner is set to De/Lg>1.5, said focusing voltage includes a first focusing voltage formed of a first direct current voltage and a second focusing voltage which is formed by superposing a dynamic voltage which is elevated corresponding to an increase of a deflection amount of said electron beams by said deflection yoke to a second direct current voltage, said focusing electrode is divided into a plurality of electrode members in the tube axis direction and said divided electrode members are comprised of a first electrode member to which said first focusing voltage is applied and a second electrode member to which said second focusing voltage is applied, and an electrostatic quadrupole lens which decreases in intensity corresponding to the elevation of said dynamic voltage is disposed at least at one portion of said focusing electrode, and said first direct current voltage is larger than said second direct current voltage and the difference between both voltages is not less than 1.4 kV.

6. A color cathode ray tube according to claim 5, wherein said dynamic voltage is not more than 600 V.

7. A color cathode ray tube according to claim 5, wherein a curvature-of-field correction lens which weakens the focusing functions in the horizontal direction as well as in the vertical direction relative to said three electron beams corresponding to the increase of said dynamic voltage is provided at least at one portion of said focusing electrode.

8. A color cathode ray tube according to claim 7, wherein said curvature-of-field correction lens is provided on said anode electrode side in the tube axis direction of said electrostatic quadrupole lens.

9. A color cathode ray tube according to claim 5, wherein electrostatic quadrupole lenses are provided at two portions of said focusing electrode.

10. A color cathode ray tube according to claim 9, wherein said electron beam generating portion is comprised of a cathode, a first electrode and a second electrode which are arranged in the direction of said anode electrode and one of said electrostatic quadrupole lenses is disposed adjacent to said second electrode.

11. A color cathode ray tube, including a vacuum envelope, which is comprised of a panel portion on which a phosphor screen formed of at least phosphors in three colors is coated and adjacent to which a shadow mask is disposed, a neck portion which accommodates an electron gun which is comprised of an electron beam generating portion which generates three electron beams arranged in the horizontal direction and a main lens portion which focuses and converges said three electron beams onto said phosphor screen, and a funnel portion which connects said panel portion and said neck portion and on which a deflection yoke is mounted for scanning three electron beams emitted from said electron gun on said phosphor screen, wherein:

said main lens portion is comprised of an anode electrode to which an anode voltage is applied and a focusing electrode to which a focusing voltage which is lower than said anode voltage is applied, said focusing voltage includes a first focusing voltage formed of a first direct current voltage and a second focusing voltage which is formed by superposing a dynamic voltage which is elevated corresponding to an increase of a deflection amount of said electron beams by said deflection yoke to a second direct current voltage, said focusing electrode is divided into a plurality of electrode members in the tube axis direction and said divided electrode members are comprised of a first electrode member to which said first focusing voltage is applied and a second electrode member to which said second focusing voltage is applied, and an electrostatic quadrupole lens which decreases in intensity corresponding to the elevation of said dynamic voltage is disposed at least at one portion of said focusing electrode, and said first direct current voltage is larger than said second direct current voltage and the difference between both voltages is not less than 1.4 kV, and said focusing electrode and said anode electrode are constituted such that said focusing electrode, and said anode electrode have single opening portions whose opening size in the horizontal direction is not less than 68% of the outer diameter of said neck portion and end surfaces of said opening portions face each other in an opposed manner in the tube axis direction along which said electron beams pass.

12. A color cathode ray tube according to claim 11, wherein the opening size in the vertical direction of said single opening portions is not less than 32% of the outer diameter of said neck portion.

13. A color cathode ray tube according to claim 12, wherein the outer diameter of said neck portion is substantially 29 mm and the opening size in the horizontal direction of said single opening portions is not less than 20 mm.

14. A color cathode ray tube according to claim 13, wherein the opening size in the vertical direction of said single opening portions is not less than 9.5 mm.

15. A color cathode ray tube according to claim 11, wherein said dynamic voltage is not more than 600 V.

16. A color cathode ray tube according to claim 11, wherein a curvature-of-field correction lens which weakens the focusing functions in the horizontal direction as well as in the vertical direction relative to said three electron beams corresponding to the increase of said dynamic voltage is provided at least at one portion of said focusing electrode.

17. A color cathode ray tube according to claim 16, wherein said curvature-of-field correction lens is provided on said anode electrode side in the tube axis direction of said electrostatic quadrupole lens.

18. A color cathode ray tube according to claim 11, wherein electrostatic quadrupole lenses are provided at two portions of said focusing electrode.

19. A color cathode ray tube according to claim 18, wherein said electron beam generating portion is-comprised of a cathode, a first electrode and a second electrode which are arranged in the direction of said anode electrode and one of said electrostatic quadrupole lenses is disposed adjacent to said second electrode.

* * * * *